US007273035B2

(12) United States Patent
Kinose

(10) Patent No.: US 7,273,035 B2
(45) Date of Patent: Sep. 25, 2007

(54) CONTROL APPARATUS FOR INTERNAL COMBUSTION ENGINE

(75) Inventor: Kenichi Kinose, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/354,878

(22) Filed: Feb. 16, 2006

(65) Prior Publication Data

US 2006/0207561 A1 Sep. 21, 2006

(30) Foreign Application Priority Data

Mar. 18, 2005 (JP) ..... 2005-078481

(51) Int. Cl.
*F02B 7/00* (2006.01)
*F02B 7/04* (2006.01)

(52) U.S. Cl. ..... 123/431; 123/491; 123/685; 123/686

(58) Field of Classification Search ..... 123/431, 123/491, 406.47, 366, 406.53, 685, 686, 123/453, 179.7, 179.16, 179.17
See application file for complete search history.

(56) References Cited

U.S. PATENT DOCUMENTS 5,179,925 A * 1/1993 Orminski ..... 123/491
5,894,832 A 4/1999 Nogi et al.
5,924,405 A * 7/1999 Hashimoto ..... 123/431
6,571,774 B2 * 6/2003 Yomogida ..... 123/491
6,986,331 B2 * 1/2006 Mizutani ..... 123/179.15
2003/0051692 A1 * 3/2003 Mizutani ..... 123/179.15
2003/0056763 A1 * 3/2003 Yomogida ..... 123/491
2003/0127072 A1 7/2003 Gmelin et al.
2004/0007209 A1 1/2004 Ohtani
2004/0237514 A1 * 12/2004 Surnilla et al. ..... 60/299
2005/0016500 A1 1/2005 Borg et al.
2005/0016503 A1 1/2005 Borg et al.
2006/0207556 A1 * 9/2006 Miyazaki et al. ..... 123/431

FOREIGN PATENT DOCUMENTS

EP 1 500 807 A2 1/2005
JP A 2002-364409 12/2002

* cited by examiner

*Primary Examiner*—Mahmoud Gimie
(74) *Attorney, Agent, or Firm*—Oliff & Berridge, PLC

(57) ABSTRACT

In an internal combustion engine where an in-cylinder injector and an intake manifold injector can both be used, initial setting of a fuel injection ratio (DI ratio) in accordance with a condition of the engine is basically carried out in response to power-up of an engine ECU. Further, it is sensed that an engine start request is made after a prescribed period has elapsed since the power-up. In such a case, an initial setting value of the fuel injection ratio is updated in accordance with the condition of the engine at that time point. Thus, the fuel injection ratio between both injectors can appropriately be set in starting the engine, so that the engine is smoothly started.

10 Claims, 2 Drawing Sheets

CONTROL APPARATUS FOR INTERNAL COMBUSTION ENGINE

This nonprovisional application is based on Japanese Patent Application No. 2005-078481 filed with the Japan Patent Office on Mar. 18, 2005, the entire contents of which are hereby incorporated by reference.

BACKGROUND OF THE INVENTION

1. Field of the Invention

The present invention relates to a control apparatus for an internal combustion engine, and particularly, to control of fuel injection in starting an internal combustion engine having a first fuel injection mechanism (an in-cylinder injector) for injecting fuel into a cylinder and a second fuel injection mechanism (an intake manifold injector) for injecting the fuel into an intake manifold and/or an intake port.

2. Description of the Background Art

With an internal combustion engine having an in-cylinder injector for injecting fuel directly into a combustion chamber and an intake port injector for injecting fuel into an intake port of each cylinder, when combustion is carried out by injecting fuel solely from the intake port injector, the in-cylinder injector is always exposed to combustion gas of high temperature without being cooled by means of vaporization of the injected fuel. Thus, the temperature of the tip thereof is constantly high, and deposits are likely to accumulate in the injection hole.

Accordingly, a control apparatus has been proposed that opens an intake port injector to inject fuel into an intake port and that concurrently opens an in-cylinder injector to inject fuel into a combustion chamber in a homogeneous combustion drive mode, in order to prevent the tip of the in-cylinder injector from being constantly at high temperatures (for example, Japanese Patent Laying-Open No. 2002-364409). That is, it is preferable to secure fuel injection from the in-cylinder injector in the homogeneous combustion drive mode where the engine is in a warm state.

On the other hand, vaporization of fuel inside the cylinder is hardly facilitated at low temperatures. Therefore, if fuel is injected from the in-cylinder injector at low temperatures, the injected fuel is likely to adhere to a top of an engine piston (a piston top) or to an internal peripheral surface inside cylinder (a cylinder internal peripheral surface (bore)) in a large amount. The fuel adhered to the piston top gradually vaporizes in the following combustion in the engine resulting in incomplete combustion, whereby deterioration of exhaust gas emission, such as generation of black smoke and an increase in uncombusted components, is invited. The fuel adhered to the cylinder internal peripheral surface mixes with and dilutes lubricant oil applied to the surface for lubricating the piston, and thus may impair the lubrication performance. Accordingly, it is preferable to minimize the fuel injection from the in-cylinder injector in the homogeneous combustion drive mode where the engine is in a cold state.

In an internal combustion engine where the in-cylinder injector and the intake manifold injector are both employed, it is necessary to set a fuel injection ratio between the injectors in accordance with a condition of the engine (such as temperature, engine speed and load). In particular, as the engine output condition is uniform in starting the engine, it is necessary to appropriately set the fuel injection ratio in accordance with the engine temperature.

The setting of the fuel injection ratio in starting the engine, i.e., a fuel injection ratio initial setting is generally executed as part of a starting sequence on power-up of a control apparatus (ECU: Electronic Control Unit). However, such a setting scheme does not ensure preferable initial setting if there is a delay between the power-up of the ECU and actual start of the engine. Thus, there still remains a possibility that the combustion state of the engine is deteriorated and the engine cannot be started smoothly.

SUMMARY OF THE INVENTION

The present invention has been made to solve such a problem, and it is an object of the present invention, as to an internal combustion engine having a first fuel injection mechanism (an in-cylinder injector) for injecting fuel into a cylinder and a second fuel injection mechanism (an intake manifold injector) for injecting the fuel into an intake manifold and/or an intake port, to appropriately set a fuel injection ratio in starting the engine, so that the engine is smoothly started.

A control apparatus for an internal combustion engine according to the present invention has a first fuel injection mechanism (an in-cylinder injector) for injecting fuel into a cylinder and a second fuel injection mechanism (an intake manifold injector) for injecting the fuel into an intake manifold, and includes a power-up sensing portion, a start request sensing portion and an injection ratio initial setting portion. The power-up sensing portion senses power-up of the control apparatus. The start request sensing portion senses that a request for starting the internal combustion engine is made after a prescribed period has elapsed since the power-up. The injection ratio initial setting portion sets a ratio (a DI ratio) between a quantity of the fuel injected from the first fuel injection mechanism and a quantity of the fuel injected from the second fuel injection mechanism as based on a total quantity of the fuel injected, in starting the internal combustion engine. In particular, the injection ratio initial setting portion sets the ratio at respective time points where the power-up is sensed by the power-up sensing portion and where the request for starting the internal combustion engine is sensed by the start request sensing portion, in accordance with a condition of the internal combustion engine at the respective time points.

According to the control apparatus for an internal combustion engine, even at a time point where a long period has elapsed since power-up of the control apparatus, an injection ratio (DI ratio) can be set in accordance with the condition at that time point. Thus, the combustion state in starting the engine can be improved to smoothly start the engine.

Preferably, in the control apparatus for an internal combustion engine according to the present invention, the injection ratio initial setting portion uses at least a temperature of the internal combustion engine as the condition of the internal combustion engine.

According to the control apparatus for an internal combustion engine, by conducting the initial setting of the injection ratio (DI ratio) in accordance with a temperature of the internal combustion engine, adhesion of fuel to the cylinder in the engine cold state and clogging in the first fuel injection mechanism (in-cylinder injector) in the engine warm state are prevented, to thereby smoothly start the engine.

Further preferably, the request for starting the internal combustion engine is made at least when an operation instruction of a starter of the internal combustion engine is generated.

According to the control apparatus for an internal combustion engine, the time point where the engine is actually started can be sensed readily and precisely.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
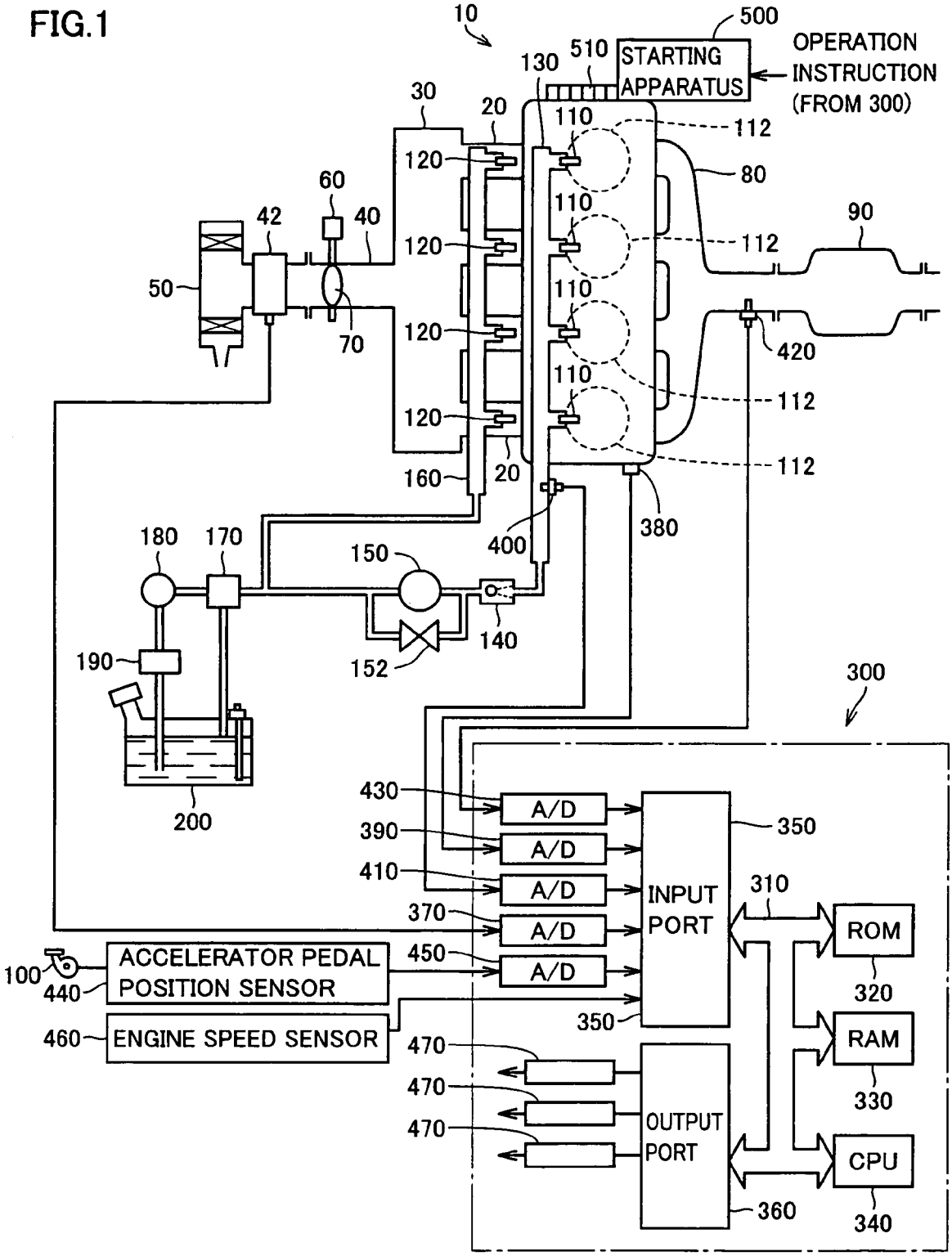
FIG. 1 is a schematic configuration diagram of an engine system controlled by a control apparatus for an internal combustion engine according to an embodiment of the present invention.

Hereinafter, an embodiment of the present invention will be described in detail with reference to the drawings. In the following, the same or corresponding parts have the same reference characters allotted and detailed description thereof will not be repeated in principle.

FIG. 1 is a schematic configuration diagram of an engine system that is controlled by an engine ECU implementing the control apparatus for an internal combustion engine according to an embodiment of the present invention. In FIG. 1, an in-line 4-cylinder gasoline engine is shown, although the application of the present invention is not restricted to such an engine.

As shown in FIG. 1, engine (internal combustion engine) 10 includes four cylinders 112, each connected via a corresponding intake manifold 20 to a common surge tank 30. Surge tank 30 is connected via an intake duct 40 to an air cleaner 50. An airflow meter 42 is arranged in intake duct 40, and a throttle valve 70 driven by an electric motor 60 is also arranged in intake duct 40. Throttle valve 70 has its degree of opening controlled based on an output signal of an engine ECU 300, independently from an accelerator pedal 100. Each cylinder 112 is connected to a common exhaust manifold 80, which is connected to a three-way catalytic converter 90.

Each cylinder 112 is provided with an in-cylinder injector 110 for injecting fuel into the cylinder and an intake manifold injector 120 for injecting fuel into an intake port or/and an intake manifold. Injectors 110 and 120 are controlled based on output signals from engine ECU 300.

In the present embodiment, an internal combustion engine having two injectors separately provided is explained, although the present invention is not restricted to such an internal combustion engine. For example, the internal combustion engine may have one injector that can effect both in-cylinder injection and intake manifold injection.

As shown in FIG. 1, in-cylinder injector 110 of each cylinder is connected to a common fuel delivery pipe 130. Fuel delivery pipe 130 is connected to a high-pressure fuel pump 150 of an engine-driven type, via a check valve 140 that allows a flow in the direction toward fuel delivery pipe 130. The discharge side of high-pressure fuel pump 150 is connected via an electromagnetic spill valve 152 to the intake side of high-pressure fuel pump 150. As the degree of opening of electromagnetic spill valve 152 is smaller, the quantity of the fuel supplied from high-pressure fuel pump 150 into fuel delivery pipe 130 increases. When electromagnetic spill valve 152 is fully open, the fuel supply from high-pressure fuel pump 150 to fuel delivery pipe 130 is stopped. Electromagnetic spill valve 152 is controlled based on an output signal of engine ECU 300.

Each intake manifold injector 120 is connected to a common fuel delivery pipe 160 on a low pressure side. Fuel delivery pipe 160 and high-pressure fuel pump 150 are connected via a common fuel pressure regulator 170 to a low-pressure fuel pump 180 of an electric motor-driven type. Further, low-pressure fuel pump 180 is connected via a fuel filter 190 to a fuel tank 200. Fuel pressure regulator 170 is configured to return a part of the fuel discharged from low-pressure fuel pump 180 back to fuel tank 200 when the pressure of the fuel discharged from low-pressure fuel pump 180 is higher than a preset fuel pressure. This prevents both the pressure of the fuel supplied to intake manifold injector 120 and the pressure of the fuel supplied to high-pressure fuel pump 150 from becoming higher than the above-described preset fuel pressure.

Engine ECU 300 is implemented with a digital computer, and includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage is input via an A/D converter 370 to input port 350. A coolant temperature sensor 380 is attached to engine 10, and generates an output voltage proportional to a coolant temperature of the engine, which is input via an A/D converter 390 to input port 350.

A fuel pressure sensor 400 is attached to fuel delivery pipe 130, and generates an output voltage proportional to a fuel pressure within fuel delivery pipe 130, which is input via an A/D converter 410 to input port 350. An air-fuel ratio sensor 420 is attached to an exhaust manifold 80 located upstream of three-way catalytic converter 90. Air-fuel ratio sensor 420 generates an output voltage proportional to an oxygen concentration within the exhaust gas, which is input via an A/D converter 430 to input port 350.

Air-fuel ratio sensor 420 of the engine system of the present embodiment is a full-range air-fuel ratio sensor (linear air-fuel ratio sensor) that generates an output voltage proportional to the air-fuel ratio of the air-fuel mixture burned in engine 10. As air-fuel ratio sensor 420, an $O_2$ sensor may be employed, which detects, in an on/off manner, whether the air-fuel ratio of the air-fuel mixture burned in engine 10 is rich or lean with respect to a stoichiometric air-fuel ratio.

Accelerator pedal 100 is connected with an accelerator pedal position sensor 440 that generates an output voltage proportional to the degree of press down of accelerator pedal 100, which is input via an A/D converter 450 to input port 350. Further, an engine speed sensor 460 generating an output pulse representing the engine speed is connected to input port 350. ROM 320 of engine ECU 300 prestores, in the form of a map, values of fuel injection quantity that are set in association with operation states based on the engine load factor and the engine speed obtained by the above-described accelerator pedal position sensor 440 and engine speed sensor 460, and correction values thereof set based on the engine coolant temperature.

Engine ECU 300 executes a prescribed program, to thereby generate various control signals for controlling the overall operation of the engine system based on signals from sensors. These control signals are sent via output port 360 and drive circuitry 470 to equipment and circuitry constituting the engine system.

In engine 10 according to the embodiment of the present invention, both in-cylinder injector 110 and intake manifold injector 120 are provided to each cylinder 112. Accordingly, it is necessary to provide fuel injection ratio control between in-cylinder injector 110 and intake manifold injector 120 as to a required total fuel injection quantity calculated as above.

In the following, the fuel injection ratio between the injectors is expressed as a ratio of the quantity of the fuel injected from in-cylinder injector 110 to the total quantity of the fuel injected, which is referred to as a "DI (Direct Injection) ratio r". Specifically, "DI RATIO r=100%" means that fuel injection is carried out using only in-cylinder injector 110, and "DI RATIO r=0%" means that fuel injection is carried out using only intake manifold injector 120. "DI RATIO r≠0%", "DI RATIO r≠100%" and "0%<DI RATIO r<100%" each mean that fuel injection is carried out using both in-cylinder injector 110 and intake manifold injector 120. In-cylinder injector 110 contributes to an improvement in output performance by improving anti-knock performance attained by the effect of latent heat of vaporization. Intake manifold injector 120 contributes to an improvement in output performance by suppressing variations in rotation (torque) attained by improved uniformity of an air-fuel mixture.

Further, a starting apparatus 500 is provided to engine 10. Generally, starting apparatus 500 is constituted by an electric motor that is electrically supplied in response to an operation instruction from engine ECU 300. When an operation instruction is issued from engine ECU 300, a flywheel 510 of engine 10 is rotated by starting apparatus (starter) 500 to start engine 10.

Generally, a starting operation by a driver can be divided into a plurality of stages. For example, in a general vehicle, the operation proceeds with a key-off state, an ACC-on state where auxiliary equipment such as audio equipment is powered up, an ignition-on state where the vehicle driveline including engine ECU 300 is powered up, and a further key operation (starter-on) against prescribed resistance from the key position of the ignition-on state, in response to which the engine is started. Furthermore, when the driver releases the key at the starter-on position, the key automatically returns to the ignition-on state.

Accordingly, power-up of engine ECU 300 and the operation instruction generation of starting apparatus 500 not always occur concurrently. Additionally, when the ignition-on and starter-on states have successively taken place and thereafter the engine fails to be started, or when the engine that has once been started is stopped by any reason (e.g., what is called engine stall), the driver operates the key again to the starter-on position. In response to the starter-on instruction by the key operation of the driver, engine ECU 300 generates an operation instruction of starting apparatus 500.

Figure 2:
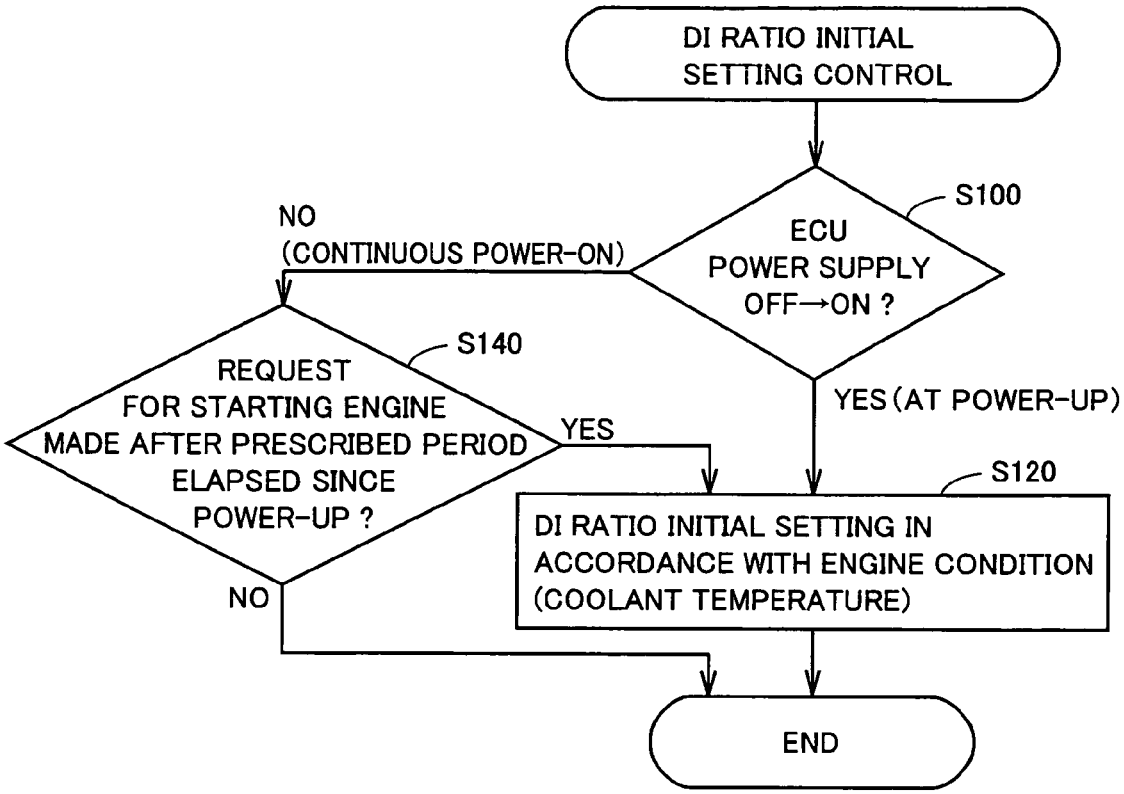
FIG. 2 is a flowchart representing fuel injection ratio initial setting control according to an embodiment of the present invention.

FIG. 2 is a flowchart representing initial setting control of a fuel injection ratio (DI ratio) according to the embodiment of the present invention.

Referring to FIG. 2, the initial setting of DI ratio is basically executed at power-up of engine ECU 300. Specifically, whether the power supply for engine ECU 300 transits from off to on is determined (step S100), and at power-up of ECU 300 (YES in step S100), the DI ratio initial setting as shown in FIG. 3 is executed (step S120).

Figure 3:
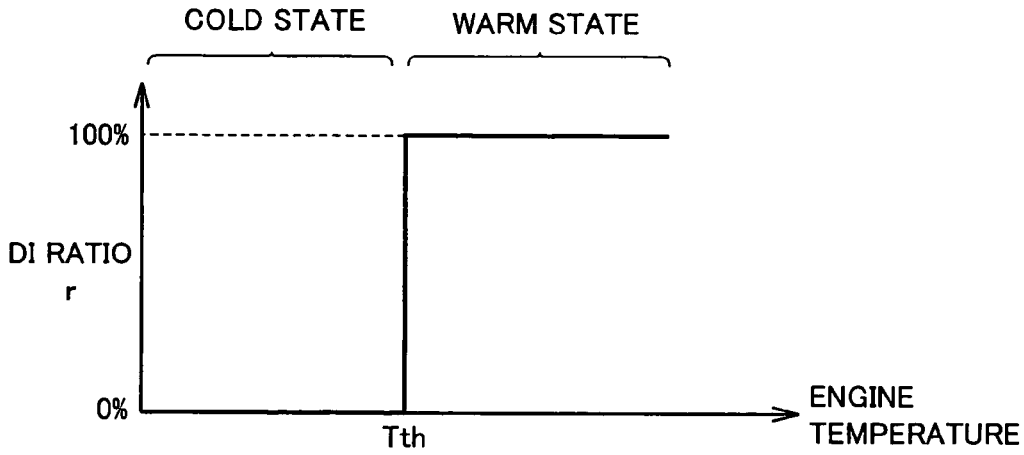
FIG. 3 is a conceptual diagram representing preferable initial setting of a fuel injection ratio in accordance with engine temperature.

Referring to FIG. 3, comparing the engine temperature (representatively, the engine coolant temperature measured by coolant temperature sensor 380) with a prescribed reference temperature Tth, the engine temperature being lower than reference temperature Tth corresponds to "an engine cold state", whereas the engine temperature being higher than reference temperature Tth corresponds to "an engine warm state". In the engine cold state, DI ratio r=0% is set so as to avoid in-cylinder injection. In the engine warm state, DI ratio r=100% is set so as to avoid clogging in the in-cylinder injector.

The DI ratio initial setting in step S120 is not limited to the example shown in FIG. 3. In consideration of smooth starting of engine 10, the engine temperature range may further be divided to provide the DI ratio setting of three or more stages. Alternatively, it is possible to further employ other parameters of engine temperature, or to depend on other parameters to execute the DI ratio initial setting. Further, irrespectively of the cold and warm states, in-cylinder injector 110 may be used in the low-load region. In other words, DI ratio r>0% may be set in either cold or warm state.

However, with DI ratio initial setting control involving only steps S100 and S120, if a long period has elapsed since power-up of engine ECU 300 until the engine is started, or if the once-started engine is stopped or stalled, for example, and requires to be re-started, the initial setting cannot be conducted based on the engine condition (in the present embodiment, representatively the engine temperature) at the time point where the engine is actually started.

Therefore, the DI ratio initial setting control according to the present invention includes a step S140 of sensing that a request for starting the engine is made after a prescribed period has elapsed since the power-up, due to a fault or the like, even at time points except for the power-up of the engine ECU (NO in step S100). When such a request for starting the engine is sensed (YES in step S140), step S120 is again executed. Thus, the DI ratio initial setting is updated from a value corresponding to the engine condition at power-up of engine ECU 300 to a value corresponding to the engine condition at the time point when it is actually started.

For example, in step S140, a request for starting the engine such as described above is sensed based on an output of a timer sensing a prescribed time elapsed since power-up and generation of an operation instruction of starting apparatus 500 by engine ECU 300. This request for starting the engine is automatically generated, not only when the engine is started by a driver's key operation, but also when engine control cannot normally be exerted due to a fault of an output signal from a crank angle sensor (not shown) attached to engine 10, for example. As to manual transmission vehicles (M/T vehicles), while the engine can also be re-started not by turning on the starter again but by connecting the clutch, it is noted that a request for starting the engine sensed in step S140 is generated also in this case.

When a request for starting the engine such as described above is not sensed (NO in step S140), the DI ratio initial setting value in step S120 executed at power-up is maintained.

As to the correspondence between the flowchart of FIG. 2 and the configuration of the present invention, step S100 corresponds to "power-up sensing means" of the present invention, step S120 corresponds to "injection ratio initial setting means" of the present invention, and step S140 corresponds to "start request sensing means" of the present invention.

With such a configuration, even when starting the engine at a time point where a long period has elapsed since power-up of engine ECU 300, DI ratio initial setting can be made in accordance with the engine condition at that time point. Thus, the combustion state in starting the engine can be improved to smoothly start the engine.

In particular, by conducting the DI ratio initial setting in accordance with the engine temperature, adhesion of fuel inside the cylinder in the engine cold state and clogging in the in-cylinder injector in the engine warm state are prevented, to thereby smoothly start the engine.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine having first fuel injection means for injecting fuel into a cylinder and second fuel injection means for injecting the fuel into an intake manifold, comprising:

power-up sensing means for sensing power-up of said control apparatus;

start request sensing means for sensing that a request for starting said internal combustion engine is made after a prescribed period has elapsed since said power-up; and injection ratio initial setting means for setting a ratio between a quantity of the fuel injected from said first fuel injection means and a quantity of the fuel injected from said second fuel injection means as based on a total quantity of the fuel injected, in starting said internal combustion engine; said injection ratio initial setting means setting said ratio at respective time points where said power-up is sensed by said power-up sensing means and where said request for starting said internal combustion engine is sensed by said start request sensing means, in accordance with a condition of said internal combustion engine at said respective time points.

2. The control apparatus for an internal combustion engine according to claim 1, wherein said injection ratio initial setting means uses at least a temperature of said internal combustion engine as said condition of said internal combustion engine.

3. The control apparatus for an internal combustion engine according to claim 1, wherein said request for staffing said internal combustion engine is made at least when an operation instruction of a starter of said internal combustion engine is generated.

4. The control apparatus for an internal combustion engine according to claim 2, wherein said request for starting said internal combustion engine is made at least when an operation instruction of a starter of said internal combustion engine is generated.

5. The control apparatus for an internal combustion engine according to claim 1, wherein said injection ratio initial setting means (i) sets said ratio in accordance with the condition of said internal combustion engine at the time point where said power-up is sensed by said power-up sensing means, when said request for starting said internal combustion engine is made before said prescribed period elapses since said power-up, and (ii) sets said ratio in accordance with a condition of said internal combustion engine at the time point where said request for starting said internal combustion engine is sensed by said start request sensing means, when said request for starting said internal combustion engine is made after said prescribed period has elapsed since said power-up.

6. A control apparatus for an internal combustion engine having a first fuel injection mechanism for injecting fuel into a cylinder and a second fuel injection mechanism for injecting the fuel into an intake manifold, comprising:

a power-up sensing portion for sensing power-up of said control apparatus;

a start request sensing portion for sensing that a request for starting said internal combustion engine is made after a prescribed period has elapsed since said power-up; and an injection ratio initial setting portion for setting a ratio between a quantity of the fuel injected from said first fuel injection mechanism and a quantity of the fuel injected from said second fuel injection mechanism as based on a total quantity of the fuel injected, in starting said internal combustion engine; said injection ratio initial setting portion setting said ratio at respective time points where said power-up is sensed by said power-up sensing portion and where said request for starting said internal combustion engine is sensed by said start request sensing portion, in accordance with a condition of said internal combustion engine at said respective time points.

7. The control apparatus for an internal combustion engine according to claim 6, wherein said injection ratio initial setting portion uses at least a temperature of said internal combustion engine as said condition of said internal combustion engine.

8. The control apparatus for an internal combustion engine according to claim 6, wherein said request for starting said internal combustion engine is made at least when an operation instruction of a starter of said internal combustion engine is generated.

9. The control apparatus for an internal combustion engine according to claim 7, wherein said request for starting said internal combustion engine is made at least when an operation instruction of a starter of said internal combustion engine is generated.

10. The control apparatus for an internal combustion engine according to claim 6, wherein said injection ratio initial setting portion (i) sets said ratio in accordance with the condition of said internal combustion engine at the time point where said power-up is sensed by said power-up sensing portion, when said request for starting said internal combustion engine is made before said prescribed period elapses since said power-up, and (ii) sets said ratio in accordance with a condition of said internal combustion engine at the time point where said request for starting said internal combustion engine is sensed by said start request sensing portion, when said request for starting said internal combustion engine is made after said prescribed period has elapsed since said power-up.

* * * * *